United States Patent [19]

York

[11] 4,121,363

[45] Oct. 24, 1978

[54] TELESCOPE SIGHT MOUNT

[76] Inventor: Ausbie A. York, 339 Arcadia Dr., Eugene, Oreg. 97401

[21] Appl. No.: 778,490

[22] Filed: Mar. 17, 1977

[51] Int. Cl.[2] ..... F41G 1/38

[52] U.S. Cl. ..... 42/1 ST; 33/250

[58] Field of Search ..... 42/1 ST; 33/245, 250

[56] References Cited

U.S. PATENT DOCUMENTS

| | | | |
|---|---|---|---|
| 2,450,466 | 10/1948 | Carlson | 42/1 ST |
| 2,452,145 | 10/1948 | Pike | 42/1 ST |
| 2,556,903 | 6/1951 | Clark | 33/245 |
| 2,580,246 | 12/1951 | Schall | 42/1 ST |
| 2,585,985 | 2/1952 | Anderson | 33/250 |
| 2,649,779 | 8/1953 | Hardgrove et al. | 33/250 |
| 2,659,150 | 11/1953 | Feerick | 33/250 |
| 2,717,447 | 9/1955 | Leupold | 33/245 |
| 3,463,430 | 8/1969 | Rubin et al. | 42/1 ST |
| 3,579,840 | 5/1971 | Heinzel | 42/1 ST |

*Primary Examiner*—Charles T. Jordan

*Attorney, Agent, or Firm*—Oliver D. Olson

[57] ABSTRACT

Front and rear couplers are adapted for attachment to a telescope sight each by means of a thin, flexible steel strap which is drawn tightly about the sight by means of opposed strap tensioning cam screws mounted in the sides of the coupler. The front coupler includes a fixed latch component arranged for releasably engaging a forward projection on a front base member, with a centering projection on the front coupler being received in a complementary centering recess in the front base, the front base being adapted for attachment to the receiver of a rifle. The rear coupler includes a pair of longitudinally movable, laterally spaced, spring loaded latch rods, the rearward ends of which are interconnected by a transverse latch bar arranged to retractably engage under a shoulder on the rearward end of a rear base member which is adapted to be secured to the rifle receiver. The rear coupler has a centering projection for reception in a complementary centering recess in the rear base.

8 Claims, 4 Drawing Figures

TELESCOPE SIGHT MOUNT

BACKGROUND OF THE INVENTION

This invention relates to telescope signals for rifles, and more particularly to a simplified mount therefor.

Telescope sight mounts provided heretofore are characterized generally by being structurally complex, including several precisely interfitting parts, thereby rendering the mounts quite costly. Some of the mounts require tilting of the scope in its longitudinal direction to achieve attachment to and detachment from a rifle. Scope mounts of this type are limited to use on only those types of rifles which permit such tilting, and even in those cases there is the likelihood of damaging the scope by inadvertently tilting the latter into the rifle. Further, some mounts of the prior art allow longitudinal displacement of the telescope sight in the event the latching mechanism is inadvertently left unlocked. In such instances the recoil action of the rifle may result in detachment of the telescope sight from the rifle, resulting in damage to the sight.

SUMMARY OF THE INVENTION

In its basic concept, the telescope sight mount of this invention includes a thin, flexible strap and a camming screw to secure a telescope sight to a coupling member which releasably engages a rifle-mounted base by means of relatively longitudinally movable latches, the coupling member and its base being releasably interlocked against relatively longitudinal displacement.

It is by virtue of the foregoing basic concept that the principal objective of this invention is achieved, namely, to overcome the aforementioned disadvantages and limitations of prior telescope sight mounts.

A specific objective of this invention is to provide a telescope sight mount which is of simplified construction for economical manufacture, which is capable of use with all types of rifles which accommodate receiver top mounts, which provides positive attachment to and easy detachment from such rifles, with maximum speed, which is of streamlined design for minimum profile, and which is of rugged construction for severe use.

The foregoing and other objects and advantages of this invention will appear from the following detailed description, taken in connection with the accompanying drawing of a preferred embodiment.

DESCRIPTION OF THE PREFERRED EMBODIMENT

Figure 1:
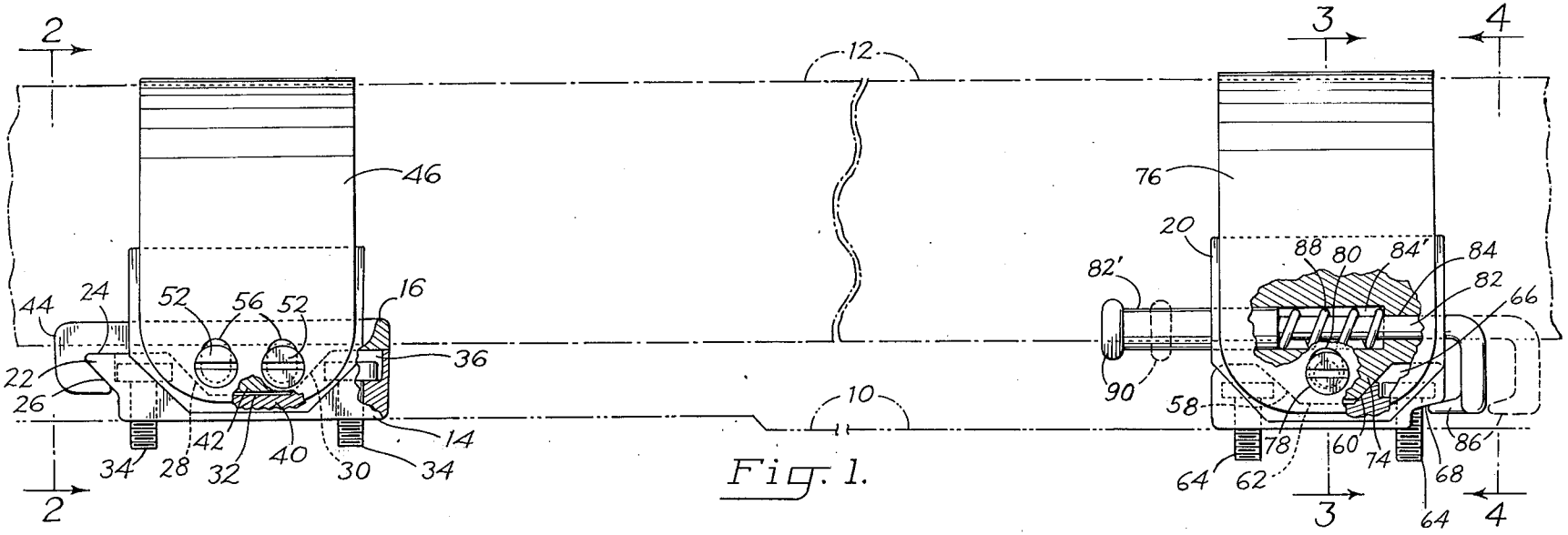
FIG. 1 is a fragmentary foreshortened side elevational view of a telescope sight mount embodying the features of this invention, the same being shown mounting a telescope sight on a rifle receiver, the sight and receiver being illustrated in broken lines, and portions of the mount being broken away to disclose internal structural details.
Figure 4:
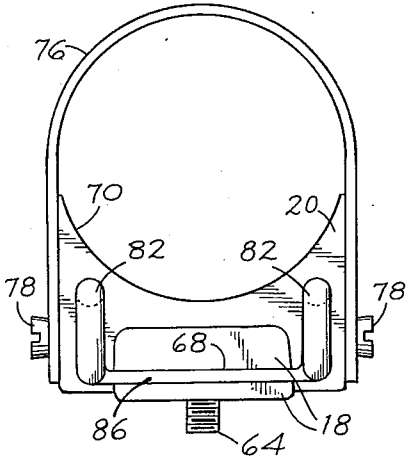
FIG. 4 is a view in rear elevation as viewed in the direction of the arrows 4—4 in FIG. 1.
Figure 3:
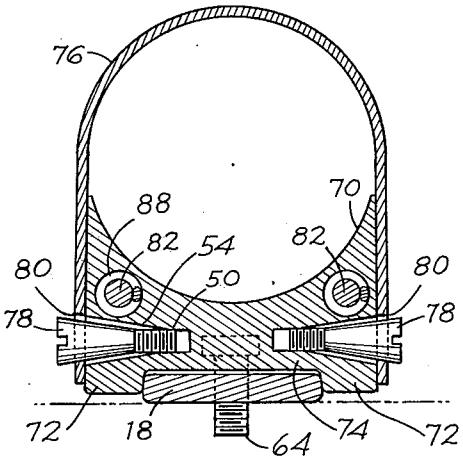
FIG. 3 is a transverse sectional view taken on the line 3—3 in FIG. 1.

As indicated above, FIG. 1 illustrates in broken lines a portion of a rifle receiver 10 and a portion of a telescope sight 12 mounted above the receiver by means of a telescope sight mount of this invention. For purposes of the following description, it is to be understood that the muzzle end of the rifle and the forward end of the telescope sight is to the left in FIG. 1.

The mount of this invention illustrated in FIG. 1 includes a front assembly of a front mounting base 14 adapted for attachment to a rifle receiver 10, and a front coupler body 16 adapted for attachment to a telescope sight 12 and for releasable coupling to the base 14. The mount also includes a rear coupling assembly including a rear base 18 adapted for attachment to the rifle receiver, at a point spaced rearwardly from the front base 14, and a rear coupler body 20 adapted for attachment to the telescope sight, rearwardly of the front coupler body 16 and arranged for releasable coupling to the rear base 18.

The front base 14 is made of a single piece of material, preferably steel, and has a bottom surface arranged to bear upon the confronting surface of the receiver. The front end of the base is provided with a forward projection 22 which, as illustrated, extends the full width of the base (FIG. 2) and is V-shape in profile (FIG. 1). The latter shape provides a top flat surface 24 and a forwardly inclined cam surface 26.

Intermediate the front and rear ends of the base 14 the upper surface of the latter is recessed transversely to provide a socket defined by the downwardly converging front and rear walls 28 and 30, respectively, and bottom 32. The function of the socket is explained in detail hereinafter.

Adjacent the front and rear ends of the base 14 the latter is apertured for receiving the attachment screws 34 by which the base is secured releasably to the receiver 10. The apertures are enlarged at their upper end, by counter bores 36 sufficiently to receive the enlarged heads of the screws, and the counter bores are of sufficient depth that the screw heads do not encroach upon the central socket.

The front coupler associated with the front base includes the main body 16, preferably of single piece construction. Its upper surface 38 is arcuately concave, on a radius substantially the same as that of the telescope sight to be mounted, to provide a saddle support for the latter. Its bottom side is contoured intermediate its lateral sides to provide laterally spaced lower side walls 40 which straddle the lateral sides of the front base 14 closely to prevent lateral displacement of the body relative to the base. Intermediate the spaced side walls the underside of the body is contoured to provide a downwardly projecting tongue 42 having an external shape complementing the internal shape of the socket in the base. The tongue thus is shaped with downwardly converging front and rear walls and a flat base. Also, the tongue extends transversely between the downwardly extending laterally spaced side walls of the body, since the socket extends the full width of the base 14.

Figure 2:
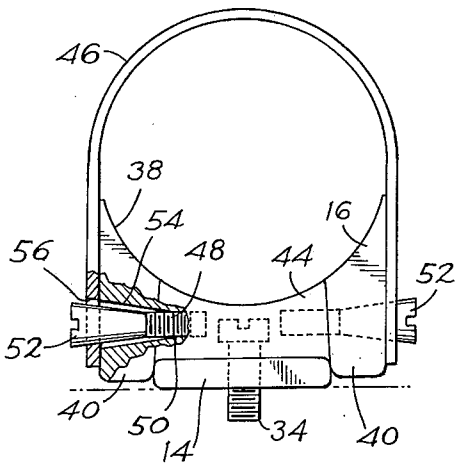
FIG. 2 is a front elevational view as viewed in the direction of arrows 2—2 in FIG. 1.

The outer sides of the base 14 and inner sides of walls 40 preferably are tapered, FIG. 2, diverging downwardly, for easier coupling and uncoupling and also to make manufacturing tolerances less critical. Also, the base of the tongue is spaced upwardly from the base 32 of the socket, to make manufacturing tolerances less critical.

The body also is provided with a forwardly projecting, fixed latch component 44. It is of hook shape in profile, providing a rearwardly facing notch which complements the profile of the forward projection 22 on the base. Thus, in the embodiment illustrated, the notch is defined by an upper horizontal surface confronting the top flat surface 24 of the base and rearwardly declining camming surface confronting the inclined surface 26 of the base.

The front coupler also includes a strap 46, preferably of steel, which is adapted to loop over a telescope sight resting in the upper saddle 38 of the coupler body 16, with the opposite ends of the strap being secured to the opposite sides of the body. The ends of the strap flare slightly outward to facilitate removal from a punch press during its manufacture. The outer sides of body 16 also diverge downwardly to correspond with the outward flare of strap 46.

In accordance with this invention, at least one and preferably both ends of the strap are secured to the body 16 by means which enables the strap to be drawn downwardly and clamped securely about the telescope sight. This is achieved, in the embodiment illustrated, by means of a pair of camming screws mounted on each side of the body. Each of the camming screws has a threaded shank 48 received in the threaded inner portion 50 of an opening in the body, and an outwardly tapered head 52 received in the unthreaded, outwardly tapered outer portion 54 of the opening in the body. A pair of vertically elongated openings 56 are provided in each end portion of the strap, arranged to register with the associated pair of openings carrying the camming screws. The elongated openings in the strap are slightly narrower in width than the maximum diameter of the tapered heads of the associated camming screws, to insure retention of the end portions of the strap on the screws.

As best illustrated in FIG. 2, the bottom edge of each of the elongated openings 56 in the strap engages the confronting surface of the outwardly tapered head of the camming screw. Thus, as the screw is threaded inward into the body, the strap ends are moved downward. The intermediate portion of the strap which overlies the telescope sight resting in the upper saddle of the body, thus also is moved downward, whereby to clamp the telescope sight securely between the body and straps.

Although the preferred embodiment illustrated provides a pair of camming screws on each side of the body, it will be understood that a single screw may be provided on each side, as discussed hereinafter in connection with the rear coupler assembly. Also, it will be understood that one end of the strap 46 may be secured firmly to the side of the body 16 and that one or more camming screws be provided only on the opposite side. The illustrated arrangement of camming screws on both sides of the body is preferred, however, since camming adjustment of both ends of the strap insures against axial rotation of the telescope sight as the strap is drawn tightly about it.

It is to be noted, in FIG. 1, that the slope of the upwardly inclined surface 26 of the projection 22 and the slope of the front surface 28 of the socket are the same. This allows coupling and uncoupling of the body 16 relative to the base 14 merely by limited longitudinal movement of the body, and hence the telescope sight 12 secured thereto, without any longitudinal tilting. This mode of operation is attainable so long as the slope of the forward surface of the socket is the same or shallower than the slope of the inclined surface of the forward projection. Stated in another way, the included acute angle formed between the inclined surface 26 of the forward projection 22 and a horizontal line should always be the same or greater than the included acute angle between the forward inclined surface 28 of the socket and a similar horizontal line, to avoid longitudinal tilting of the sight 12 during mounting and dismounting.

The rear base 18 is similar to the front base 14 in that has a bottom surface arranged to conform to the confronting surface of the rifle receiver 10; it has a socket intermediate its end defined by the front and rear converging walls 58 and 60, respectively, and the flat bottom 62; longitudinally spaced vertical apertures for the attaching screws 64, with the counter bored upper portions 66 of the heads of the screws.

The rear base also is provided at its rearward end with a locking shoulder 68. In the embodiment illustrated, this shoulder is provided by cutting away a portion of the base 18 at the rearward bottom end thereof, preferably across the full transverse dimension of the base.

The rear coupler body 20 also is similar to the front coupler body in that it includes a unitary body having an upper arcuately concave saddle 70, laterally spaced, downwardly diverging side walls 72 for extending downward closely adjacent the downwardly diverging lateral sides of the rear base 18 to prevent lateral displacement of the body; a downwardly projecting tongue 74 between the side walls 72 having downwardly convering front and rear walls and a bottom flat wall, complementing the walls 58, 60 and 62 defining the socket in the base 18. The rear coupler also includes a downwardly flared flexible strap 76 to be looped over the telescope sight seated in the saddle 70 of the body, and secured to the downwardly flared side walls of the body 20 by one or more camming screws 78 each extended through a vertically elongated slot 80 in the end portion of the strap and threaded into an opening in the body, in the same manner as described hereinbefore in connection with the front coupler assembly.

The rear coupler also includes longitudinally movable latching means by which to releasably interconnect the coupler body 20 and base 18. In the embodiment illustrated, this is provided by a pair of laterally spaced elongated rods 82 each of which extends through a longitudinal bore 84 in the body 20. The rearward ends of the rods are bent downward and are interconnected at their bottom ends by a transverse latch bar 86 disposed for releasable engagement with the locking shoulder 68 upon longitudinal movement of the interconnected rods 82.

Means is provided for urging the latch bar 86 resiliently forward into engagement with the locking shoulder 68. In the embodiment illustrated, at least one, and preferably both of the elongated rods are provided with forward end portions which are threaded to receive the elongated and enlarged nuts 82' which are receivable slidably in correspondingly enlarged forward portions 84' of the longitudinal bores through the body. A coil spring 88 encircles the smaller diameter portion of at least one of the rods within the enlarged bore and abuts at its forward end against the inner end of the nut and at its rearward end against the inner end of the enlarged portion of the bore. The coil springs thus urge the rods and the interconnecting latch bar 86 in the forward direction.

The forward ends of the nuts 82' preferably are provided with enlarged buttons 90 against which the fingers of a hand may press in moving the rods and the interconnecting latch bar 86 rearwardly against the compression of the springs 88, when it is desired to detach the coupler body 20 from the base 18.

It is to be noted that the slope of the front wall 58 of the socket in the rear base is the same as the slope of the front wall 28 of the socket in the front base. As described hereinbefore, so long as the included angle between the slope of the front wall 58 and a horizontal line is the same or less than the correspondingly included acute angle of the forward projection 22 of the front base, attachment and detachment of the telescope sight 12 may be achieved simply by a slight longitudinal movement relative to the rifle receiver 10, without any longitudinal tilting of the sight.

The elimination of longitudinal tilting of the telescope sight relative to the receiver, enables the mounting of the telescope sight on any and all types of rifles which accommodate receiver top mounts, since the vertical spacing between the sight and receiver may be substantially eliminated, if required.

The operation of the telescope sight mount described hereinbefore is as follows: With the front and rear bases 14 and 18 secured to the receiver 10 of a rifle, by means of the attaching screws 34 and 64, and with the front and rear coupler bodies and straps secured in correspondingly spaced positions on a telescope sight, the latter is attached to the rifle receiver in the following manner: The telescope sight is grasped by one hand in the area of the rear coupling strap 76. The thumb and first or second finger of the hand are placed against the buttons 90 at the forward ends of the rods 82 and pressure applied to move the latter rearwardly at least to the position illustrated in broken lines in FIG. 1. The telescope sight then is lowered toward the top of the rifle receiver, substantially parallel therewith, to a position at which the hook of the fixed latch 44 on the body 16 of the front coupler passes downward in front of the forward projection 22 on the front base, until the front sloping surfaces 28 and 58 of the sockets of the front and rear coupler assemblies are contacted by the front surfaces of the tongues 42 and 74. By pulling rearward on the telescope sight, the front sloping surfaces of the tongues slide downward along the confronting front surfaces of their associated sockets until the tongues are seated fully in the sockets. In this position the fixed latch hook 44 is engaged fully with the forward projection 22 on the front base and the transverse latch bar 86 is lowered into alignment with, but rearwardly of, the locking shoulder 68 on the rear base. Rearward finger pressure on the buttons 90 of the latch rods then is released, whereupon the force of the coil springs 88 urges the rods forwardly and brings the transverse latch bar 86 into locking engagement with the surface of the locking shoulder 68.

It is to be noted that, in the installed position of the telescope sight on the receiver, longitudinal displacement of the sight relative to the receiver, by such influences as rifle recoil is prevented because of the interlocking arrangement of the transverse sockets and tongues.

In the event it is desired to rotate the telescope sight on its longitudinal axis, such as for squaring cross hairs with the horizontal and vertical, this may be accomplished simply by loosening the camming screws sufficiently to release the clamping grip on the telescope sight housing to enable its rotation, after which the screws are retightened.

To detach the telescope sight from the rifle receiver, rearward finger pressure is applied to the forward button ends 90 of the latch rods so as to move the transverse latch bar 86 to the release position illustrated in broken lines in FIG. 1. The telescope then is moved longitudinally forward, without longitudinal tilting, to cause the front sloping surfaces of the tongues on the front and rear coupler bodies to slide upward along the confronting front sloping surfaces of the associated sockets. This results in disengagement of the fixed latch hook 44 from the forward projection 22 on the front base and elevation of the latch bar 86 above the rearward end of the rear base, thereby completing the disengagement without any longitudinal tilting of the telescope sight.

It will be recognized that the mount of this invention may be utilized to mount a telescope sight interchangeably on a number of rifles, simply by providing each of the rifles with a set of front and rear bases secured to the receivers in positions corresponding to the spacings of the coupler bodies on the telescope sight. Similarly, a plurality of different types of telescope sight, for example those provided with different degrees of magnification and/or with different types of reticules such as post, dot, cross hairs, etc., may be utilized with a single rifle by providing each sight with a set of front and rear couplers secured in positions corresponding to the spacings of the front and rear bases on the rifle.

If the receiver 10 is not stepped, as in the illustrated form, the front base 14 needs to be of greater vertical thickness to match the rear base and thus align the saddles 38 and 70 on a common plane. Notwithstanding this requirement, both bases 14 and 18 still are of sufficiently low profile as to accommodate use of the conventional iron sights provided on the rifle, if desired.

It will be appreciated that the mount of this invention illustrated in FIGS. 1–4 is of simplified construction for economical manufacture. The front and rear coupler assemblies are made up of a minimum number of parts, none of which require such a degree of precision in manufacture as to contribute to excessive cost.

It will be apparent to those skilled in the art that various changes may be made in the size, shape, type, number and arrangement of parts described hereinbefore. For example, although the preferred arrangement illustrated locates the fixed latch 22, 44 at the forward end of the mount and the releasable latch 86 at the rearward end, the provision of the interlocking sockets and tongues allows the latches to be reversed in location. The coil spring 88 may be located externally of the coupler, body 20, as by encircling the outer, enlarged portion 82' of the rod 82. The concealed position illustrated is preferred, however, for protection of the spring against damage and for streamlining the assembly. The front and rear assemblies may be integrated into a single unit comprising a single base having a projection 22 on one end, a locking shoulder 68 on the other and an intermediate socket; a single coupler body having a fixed lach 44 on one end, a movable latch bar 82 on the other and an intermediate tongue and a single strap 46 and 76. These and other changes may be made, as desired, without departing from the spirit of this invention.

Having now described my invention and the manner in which it may be used, I claim:

1. A telescope sight mount for rifles, comprising:

a. a base adapted for attachment to a rifle, b. a coupler body secured detachably to the base and arranged to engage a telescope sight,
c. a coupler strap extending upwardly from the coupler body and defining between them a telescope sight confining space, and
d. cam means interengaging the coupler body and at least one end of the strap for moving said strap end vertically relative to the coupler body for varying the vertical dimension of said confining space for releasably clamping a telescope sight between them, said cam means comprising a cam screw projecting laterally from the coupler body and having a threaded inner portion engaging a threaded bore in the side of the coupler body and an outwardly flared cam head portion extending laterally outward from the side of the coupler body through an upwardly elongated cam opening in the strap.

2. A telescope sight mount for rifles, comprising:
a. a base adapted for attachment to a rifle,
b. a coupler body secured detachably to the base and arranged to engage a telescope sight,
c. a coupler strap comprising a length of flexible material extending upwardly from the coupler body and defining between them a telescope sight confining space, and
d. cam means interengaging the coupler body and each end of the strap for moving said strap end vertically relative to the coupler body for varying the vertical dimension of said confining space for releasably clamping a telescope sight between them, said cam means comprising a cam screw projecting laterally from each side of the coupler body and having a threaded inner portion engaging a threaded bore in the side of the coupler body and an outwardly flared cam head portion extending laterally outward from the side of the coupler body through an upwardly elongated cam opening in the corresponding end of the strap for cooperative association with the corresponding cam screw.

3. A telescope sight mount for rifles, comprising:
a. a base adapted for attachment to a rifle,
b. a coupler body secured detachably to the base and arranged to engage a telescope sight,
c. a coupler strap extending upwardly from the coupler body and defining between them a telescope sight confining space,
d. cam means interengaging the coupler body and at least one end of the strap for moving said strap end vertically relative to the coupler body for varying the vertical dimension of said confining space for releasably clamping a telescope sight between them, said cam means comprising a cam screw projecting laterally from the coupler body and having a threaded inner portion engaging a threaded bore in the side of the coupler body and an outwardly flared cam head portion extending laterally outward from the side of the coupler body through an upwardly elongated cam opening in the strap,
e. a longitudinally extending fixed latch projection on one end of the base,
f. a reversely bent fixed latch hook extending longitudinally of the coupler body for releasable engagement with the latch projection on the base,
g. a locking shoulder on the end of the base opposite the latch projection,
h. a reversely bent, longitudinally movable latch member extending longitudinally of the coupler member adjacent the locking shoulder for releasable engagement therewith, and
i. releasably interengageable tongue and socket means on the base and coupler body providing transversely extending mutual abutment surfaces for preventing longitudinal displacement of the coupler body relative to the base.

4. The telescope sight mount of claim 3 wherein the longitudinally extending fixed latch projection is provided with an angular cam surface, the reversely bent fixed latch hook is provided with an angular cam surface engageable with the cam surface on the latch projection for drawing the coupler body and base together, and the mutual abutment surfaces of the tongue and socket means adjacent the fixed latch hook extends longitudinally at a slope no greater than the slope of the angular cam surfaces on the latch projection and fixed latch hook.

5. A telescope sight mount for rifles, comprising:
a. front and rear base members adapted for attachment to a rifle at longitudinally spaced positions,
b. front and rear coupler body members secured detachably to the front and rear base members, respectively,
c. front and rear coupler strap members extending upwardly from the front and rear coupler body members, respectively, and defining between them telescope sight confining spaces,
d. front and rear cam members interengaging the front and rear coupler body members and at least one end of the associated strap members for moving said strap end vertically relative to the coupler body for varying the vertical dimension of said confining space for releasably clamping a telescope sight between them, each cam member comprising a cam screw projecting laterally from the coupler body member and having a threaded inner portion engaging a threaded bore in the side of the coupler body member and an outwardly flared cam head portion extending laterally outward from the side of the coupler body member through an upwardly elongated cam opening in the strap member,
e. a fixed latch projection extending longitudinally forward on the front end of the front base member,
f. a reversely bent fixed latch hook extending longitudinally on the front end of the front coupler body member for releasable engagement with the latch projection on the front base member,
g. a locking shoulder on the rear end of the rear base member,
h. a reversely bent, longitudinally movable latch member extending longitudinally rearward of the rear end of the rear coupler body member for releasable engagement with the locking shoulder,
i. spring means interengaging the movable latch member and rear coupler body member for urging the latch member forwardly into locking engagement with the locking shoulder, and
j. releasably interengageable tongue and socket means on each base and coupler body member providing transversely extending mutual abutment surfaces for preventing longitudinal displacement of each coupler body member relative to its associated base member.

6. A telescope sight mount for rifles, comprising:
a. a base adapted for attachment to a rifle, b. a coupler secured detachably to the base and arranged for attachment to a telescope sight, c. a longitudinally extending fixed latch projection on one end of the base, d. a reversely bent fixed latch hook extending longitudinally of the coupler for releasable engagement with the latch projection on the base, e. a locking shoulder on the end of the base opposite the latch projection, f. a reversely bent, longitudinally movable latch member extending longitudinally of the coupler adjacent the locking shoulder for releasable engagement therewith, and g. releasably interengageable tongue and socket means on the base and coupler providing transversely extending mutual abutment surfaces for preventing longitudinal displacement of the coupler relative to the base.

7. The telescope sight mount of claim 6 wherein the longitudinally extending fixed latch projection is provided with an angular cam surface, the reversely bent, fixed latch hook is provided with an angular cam surface engageable with the cam surface on the latch projection for drawing the coupler and base together, and the mutual abutment surfaces of the tongue and socket means adjacent the fixed latch hook extend longitudinally at a slope no greater than the slope of the angular cam surfaces on the latch projection and fixed latch hook.

8. The telescope sight of claim 6 wherein:

a. the base includes front and rear base members adapted for attachment to a rifle at longitudinally spaced positions, b. the coupler includes front and rear coupler members secured detachably to the front and rear base members, respectively, c. a fixed latch projection extends longitudinally forward on the front end of the front base member, d. a reversely bent fixed latch hook extends longitudinally on the front end of the front coupler member for releasable engagement with the latch projection on the front base member, e. a locking shoulder is provided on the rear end of the rear base member, f. a reversely bent, longitudinally movable latch member extends longitudinally rearward of the rear end of the rear coupler member for releasable engagement with the locking shoulder, g. spring means interengages the movable latch member and rear coupler member for urging the latch member forwardly into locking engagement with the locking shoulder, and h. releasably interengageable tongue and socket means on each base and coupler member provide transversely extending mutual abutment surfaces for presenting longitudinal displacement of each coupler member relative to its associated base member.

* * * * *